United States Patent [19]

Zimmiond

[11] Patent Number: 4,892,477

[45] Date of Patent: Jan. 9, 1990

[54] APPARATUS FOR FLARING GAS

[76] Inventor: Larry Zimmiond, Highway 23, P.O. Box 7, Keene, N. Dak. 58847

[21] Appl. No.: 102,605

[22] Filed: Sep. 30, 1987

[51] Int. Cl.[4] ..... F23D 13/20

[52] U.S. Cl. ..... 431/202; 166/267

[58] Field of Search ..... 431/202; 166/265, 266, 166/267; 137/247.41, 247.43, 247.45, 247.47, 247.49, 247.25, 172, 251.1

[56] References Cited

U.S. PATENT DOCUMENTS

| | | | |
|---|---|---|---|
| 119,884 | 10/1871 | Roberts | 166/267 |
| 406,977 | 7/1889 | Wade | 137/247.51 X |
| 1,602,190 | 10/1926 | Eddy et al. | 166/267 |
| 2,891,607 | 6/1959 | Webster et al. | 431/202 X |
| 2,971,605 | 2/1961 | Frost et al. | 431/350 X |
| 3,279,520 | 10/1966 | von Wiesenthal | 431/202 X |
| 3,662,669 | 5/1972 | Cullinane, Jr. | 431/202 X |
| 3,742,974 | 4/1973 | Phillips | 137/172 |
| 3,756,765 | 9/1973 | Sparrow et al. | 431/202 |
| 4,140,471 | 2/1979 | Straitz et al. | 431/202 X |
| 4,408,665 | 10/1983 | Dougan | 166/267 X |
| 4,516,932 | 5/1985 | Chaudot | 431/202 |
| 4,610,622 | 9/1986 | Quinnell | 431/202 X |
| 4,661,127 | 4/1987 | Huntley | 166/267 X |

*Primary Examiner*—Carl D. Price

*Attorney, Agent, or Firm*—Staas & Halsey

[57] ABSTRACT

An apparatus for flaring waste gas from an oil well which utilizes hydrostatic pressure developed from a fluid reservoir maintained in a gooseneck pipe to prevent gas vapors in the flaring stack from escaping to a fluid pit. The fluid pit is utilized to store fluids which are filtered out of the waste gas. By use of the gooseneck system, the fluid pit, which often contains flammable materials, is isolated from the flare pit to prevent unwanted ignition of the materials in the fluid pit.

3 Claims, 2 Drawing Sheets

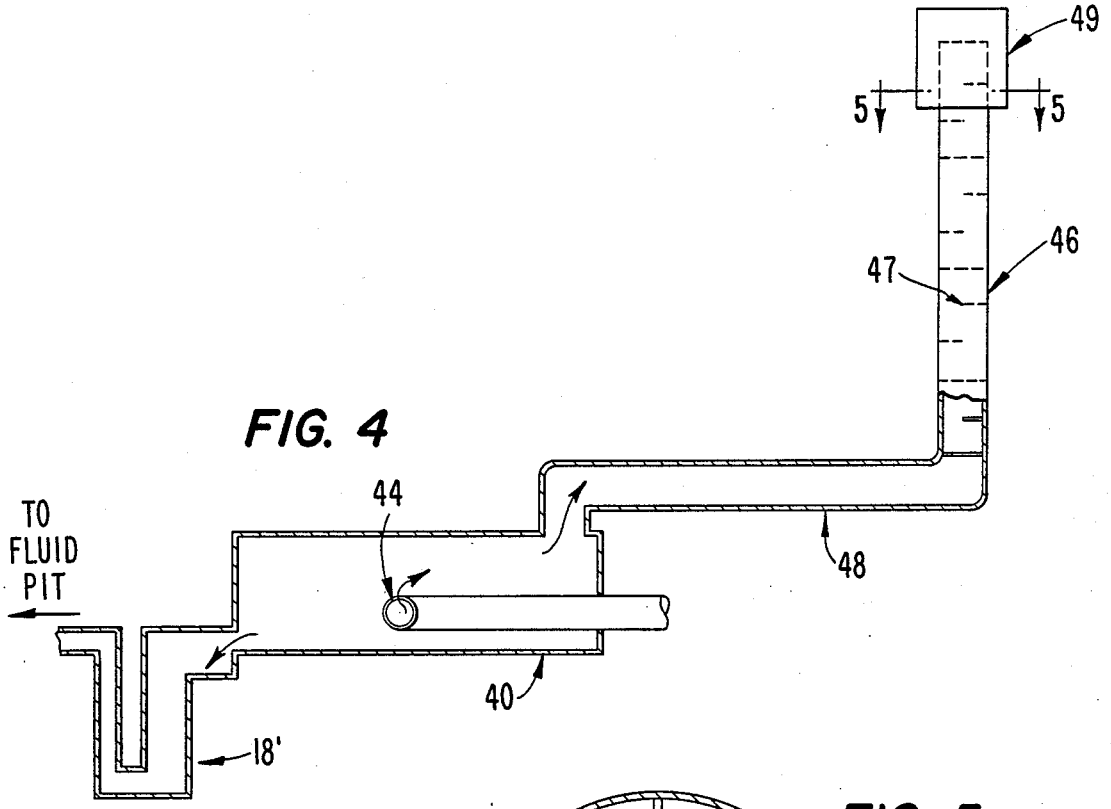
FIG. 4
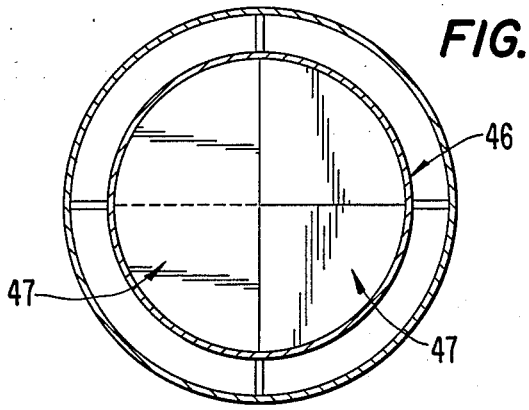
FIG. 5
FIG. 6
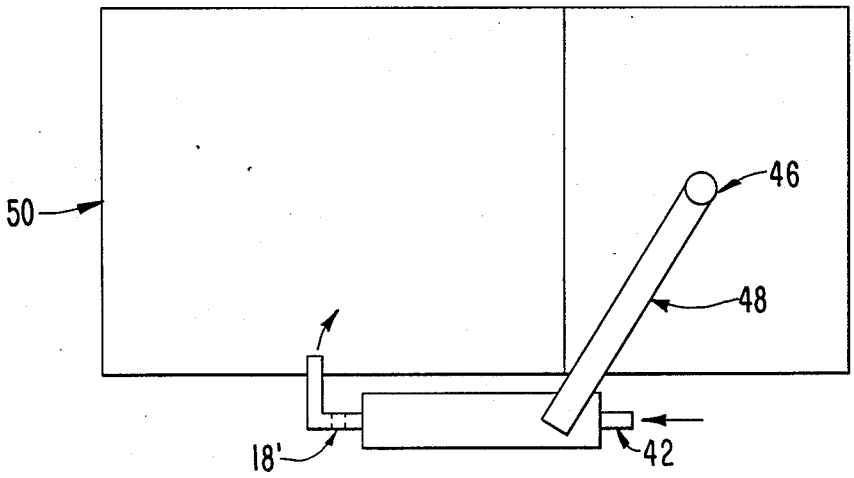

APPARATUS FOR FLARING GAS

BACKGROUND OF THE INVENTION

1. Field of the Invention

This invention relates to a method and apparatus for flaring or burning gas, and more particularly, to a method and apparatus which safely and efficiently flares or burns gas from an oil well.

2. Description of the Related Art

When oil is extracted from the earth, a certain amount of gas comes up through the well. In situations where there is no convenient way to collect the gas, it is simply burned. Several devices have been developed to flare or burn the gas.

In normal operation of an oil well, a mixture of oil, gas and water or other liquid comes up through a pipe under varying degrees of pressure. When the mixture reaches the surface it is fed into a three-stage vessel which separates the gas and water from the oil. The gas normally is sent through a vertical pipe extending above the ground and burned. The water and other liquids are deposited into a pit adjacent to the well. That pit often contains flammable material. Burning the gases directly into the atmosphere sometimes can result in the flammable materials in the pit catching on fire.

Systems for flaring or burning gas from oil wells are known in the art. Conventional methods for flaring or burning gas include methods wherein a flow of gas is directed into an expansion chamber where expansion and condensation take place. The gas is then transmitted upwardly within the chamber where it is vented and burned as it exits from the open top of the chamber. Quinnell, U.S. Pat. No. 4,610,622 teaches a method and apparatus for igniting flare gas using the above-mentioned technique. Quinnell includes an aperture provided for allowing condensation in any other vapors or fluids to drain into the bottom portion of the chamber, where they are drained away. Cullinane, Jr., U.S. Pat. No. 3,662,669, teaches an airflow control for a flare stack. Cullinane teaches a housing, divided into a series of interconnected longitudinally extending annular passages, through which gases rising in the stack flow upwardly and downwardly and again upwardly, creating zones at different pressures in the housing to limit the volume of air flowing downwardly into the stack when an upward flow of gas is interrupted. Cullinane includes a "gooseneck" pipe for draining condensation, rain, snow, etc. from the stack without venting gas through the gooseneck. Frost et al., U.S. Pat. No. 2,971,605, discloses, in a method and apparatus for flaring combustible gaseous materials, the hydrostatic regulation of gas pressure, i.e., a reservoir of water is utilized to impede the flow of gas into a combustion area until the gas is of a sufficient pressure.

SUMMARY OF THE INVENTION

It is an object of the present invention to provide an efficient and economical way to flare or burn waste gas.

Another object of the present invention is to provide a method and apparatus for burning or flaring waste gas which prohibits the ignition of liquids which are drawn away from the gas prior to the ignition of the gas.

According to the present invention, the initial gas under high pressure is fed into a high pressure manifold and is sent up through the top of a stack where it burns in the air. Liquids are separated from the gas in a separator and are routed into a pit adjacent to the stack. The stack is of sufficient height to keep the materials in the pit from catching on fire. As the oil is treated further, a secondary amount of gas is extracted from the oil. This gas is under lower pressure than the gas derived from the initial separation step, and this secondary supply of gas is fed into the low pressure manifold and sent out into the top of the stack to be burned. In a first embodiment, a high pressure inlet and a low pressure inlet, which introduce waste gas into a cone shaped stack is provided, and a "gooseneck" pipe is used to draw away any fluid contained in the waste gas. These liquids are drained from the stack to a fluid pit. Hydrostatic pressures, present due to a fluid reservoir maintained in the gooseneck, prevent gas vapors in the stack from escaping to the fluid pit. By providing the gooseneck with a narrow portion, the liquid reservoir is prevented from being blown out of the gooseneck by any gas pressure. In a second embodiment, a flare pot is provided for catching fluid vented into the flare pot by an incoming, low pressure fluid and gas line.

BRIEF DESCRIPTION OF THE DRAWINGS

FIG. 4 is a side partial cut-away view of a second embodiment of the present invention;

FIG. 5 is a top view of the stack of the embodiment shown in FIG. 4;

FIG. 6 is a top view of the embodiment shown in FIG. 4.

DESCRIPTION OF THE PREFERRED EMBODIMENT

Figures 1, 2, 3:
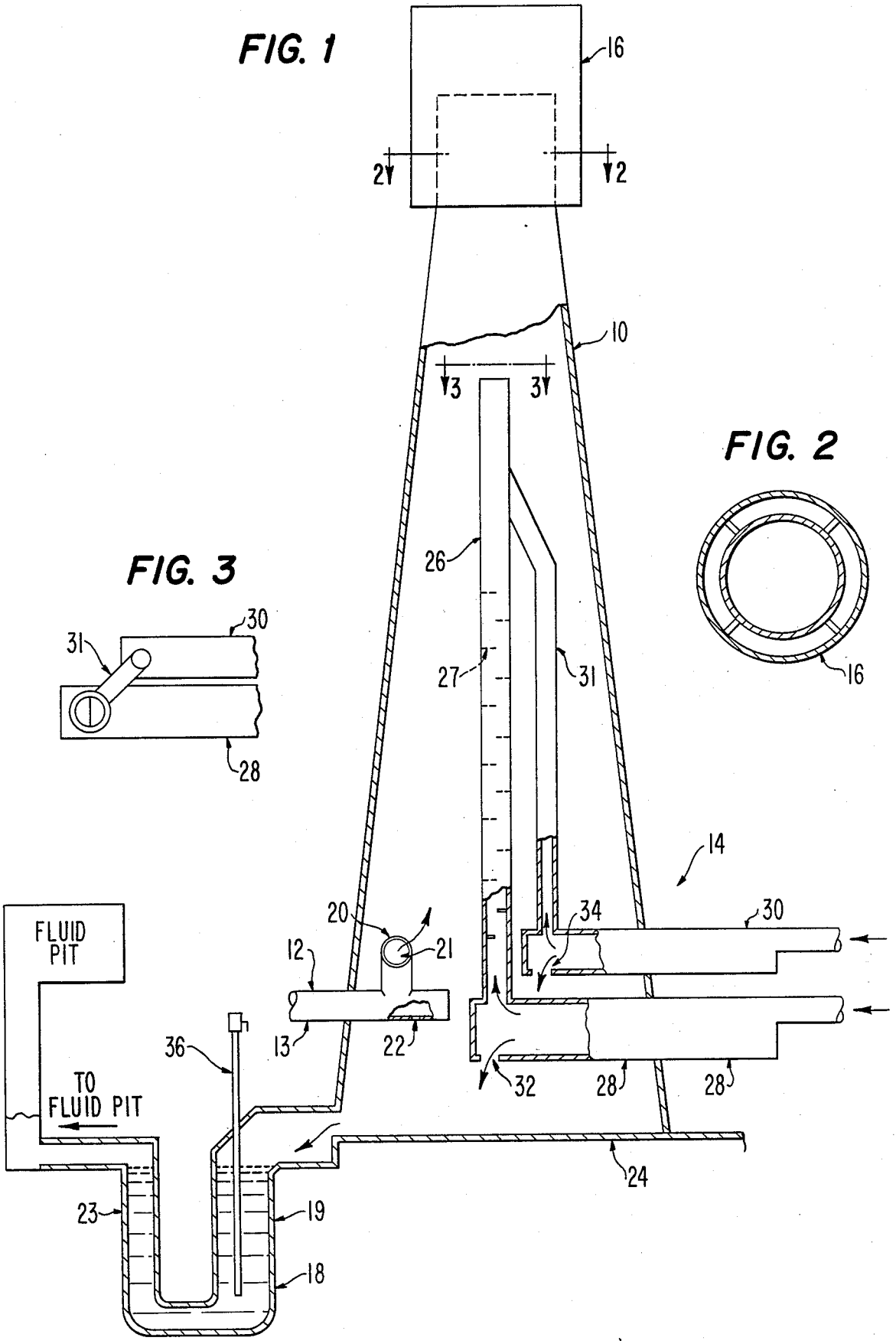
FIG. 1 is a side, partial cut-away, elevational view of a preferred embodiment of the present invention.
FIG. 2 is a top view of the shroud provided at the top of the stack system shown in FIG. 1.
FIG. 3 is a top view of the inner stack system.

FIG. 1 is a side elevational view of the gooseneck flare gas ignition apparatus of the present invention. The system comprises cone shaped stack 10, high pressure inlet 12, low pressure inlet 14, shroud 16, and gooseneck 18.

The high pressure inlet 12 includes a pipe 13 which feeds gases under high pressure into the stack. The end of the pipe includes a T-shaped pipe 20 for allowing the gas to be vented into the stack. The gas is vented through vent holes 21 situated at both ends of the T. The T shape of the pipe inhibits fluid from being blown out into the stack. Aperture 22 allows drainage of fluids contained within the gas. The vent holes 21 in the T-shaped member are situated such that they force the gas to the sides of the cone-shaped stack 10, thus causing a spiral motion of the gas as it escapes the stack. This spiral motion helps inhibit the flow of fluids contained in the gas, thus preventing release of the fluids out of the stack. Bottom portion 24 of the apparatus is angled towards the gooseneck 18. Thus, any fluid drained out through the aperture 22 will be directed towards, and into, the gooseneck 18.

The low pressure inlet 14 is designed to keep gases that have been introduced to the stack via the high pressure inlet from affecting the flow of gases coming in through the low pressure inlet. Low pressure inlet 14 is essentially a set of "inner stacks". Inner stack 26 is provided with spaced baffles 27 on alternate sides of the interior walls of the inner stack 26. The baffles help to inhibit the upward travel of any fluids present in the gas vapors. Fluid catch 28 is coupled to the inner stack 26 on one end and the other end is attached to any vessels, blow down equipment or other equipment which contains gases of a pressure of approximately 250 pounds per square inch or less. A second fluid catch 30 is provided and is vented into the inner stack 26 near the top portion thereof via inner stack 31, and on the other end is coupled to holding tanks or similar equipment which hold gas which is under a minimal amount of pressure (for example—ounces per square inch). Fluid catch 28 and fluid catch 31 each comprise, for example, a vertical pipe connected to inner stacks 26 and 30 respectively, as shown in FIG. 1 Fluid catches 28 and 30 also include escape holes 32 and 34, respectively, for providing a place for any fluids to drain into the gooseneck. As can be seen in FIG. 1, the fluid catches 28 and 30 are larger in diameter than the inlet pipe to which they are attached, forming a catch for the fluid. FIG. 3 shows a top view of the inner stack system of low pressure inlet 14.

Shroud 16 provides protection for the stack system from the wind and provides a means for out flow as the flare burns.

Gooseneck 18 is the means by which fluid is drawn away from the stack. A reservoir of water (preferably salt water to prevent freezing and cold temperatures) is used. This reservoir keeps any vapors present in the stack from escaping to a fluid pit (not shown) which holds any fluids drawn from the gases. The gooseneck is of a larger diameter in the portion 19 closest to the stack than that of the portion 23 away from the stack. This arrangement creates a back pressure to keep the water in the gooseneck from being blown out from pressure within the stack. Additionally, it maintains the reservoir for holding water taken, from the gas vapors. Cleanout pipe 36 is provided for use when it becomes necessary to clean the gooseneck.

A second embodiment of the invention shown in FIGS. 4–6 allows efficient venting of low pressure gas. The second embodiment comprises a flare pot 40 for catching fluid vented into the flare pot by an incoming fluid and gas line 42. The incoming fluid and gas line 42 includes a T-shaped termination 44 similar to T-shaped portion 20 of the high pressure inlet of the first embodiment shown in FIG. 1. The T-shaped termination 44 prevents a direct "blow down" into the stack 46 or the gooseneck 18', because it directs fluids and gases to the sides of the flare pot rather than directly into the stack 46 or gooseneck 18'. The fluid caught in the flare pot is drained away to a fluid pit (not shown) by means of gooseneck 18' essentially the same as that of the first embodiment. Stack 46 is coupled to the flare pot by means of a pipeline 48. The stack 46 includes baffling 47 similar to that of the inner stack of the first embodiment to allow easy escape of the gas while providing blockage of fluids contained in the gas. Stack 46 also has a shroud 49 at its upper end. As can be seen in FIG. 5, which is a top view looking down the stack 46, the baffling is staggered. The baffles 47 are semicircular 180° segments which are positioned in a staggered fashion, each placed in a position rotated approximately 90° from the prior baffle.

FIG. 6 is a top view of the system shown in FIG. 4. FIG. 6 includes fluid pit 50 which is used for storage of fluids withdrawn from the gases via the flare pot 40 and gooseneck 18'. As can be seen from the FIGS. 4 and 6, the reservoir in the gooseneck isolates the potentially flammable materials in the fluid pit from the flames at the top of the stack 46.

In operation of the first embodiment, high pressure gases are vented into the stack 10 via the high pressure inlet 12. The T shaped pipe 20 directs the gases towards the walls of the stack 10, causing the gases to spiral upward towards the top of the stack. This allows the gases further time to cool, thus allowing further condensing of liquids contained within the gas. Additionally, fluids are drained through aperture 22. These fluids travel to the base 24 which directs the fluids into the gooseneck 18. Moreover, low pressure gases are introduced through low pressure inlet 14. Gases flow up inner stack 26. Liquids inhibited by baffles 27 within the inner stack fall back toward the base of the stack 10 and are drained out through aperture 32, where they are also routed towards gooseneck 18. Similarly, gases of extremely low pressure are vented up through fluid catch 30, while liquids contained therein are drained through aperture 34, where they are routed to the gooseneck 18. All the gases are vented out the top portion of the stack where they are burned. The fluids which have travelled to the gooseneck 18 are withdrawn into fluid pit 50 for storage. The reservoir contained in the gooseneck 18 keeps the flammables gases isolated from the fluid pit, thus preventing a catastrophic explosion in the fluid pit. The gooseneck is periodically drained to a separator (not shown) where the liquid in the gooseneck is treated to separate the reservoir liquid (saltwater in the previous example) from the liquids removed from the high and low pressure gases. The reservoir liquid is then replaced with clean reservoir liquid. This draining and separating process is performed when the flare gas is not being burned.

The many features and advantages of the invention are apparent from the detailed specification, and thus it is intended by the appended claims to cover all such features and advantages of the invention which fall within the true spirit and scope thereof. Further, since modifications and changes will readily occur to those skilled in the art, it is not desired to limit the invention to the exact construction and operation illustrated and described, and accordingly all suitable modifications and eqivalents may be resorted to, falling within the scope of the invention.

What is claimed is:

1. An apparatus for flaring gas, comprising:

flare stack means, having a base, for flaring gas;

fluid pit means for storing fluid;

gooseneck pipe means, coupled to the base of said flare stack means and to said fluid pit means, said gooseneck pipe means being configured to maintain a reservoir of fluid therein at a predetermined level;

high pressure inlet means for introducing a first combination of waste gas and liquid of a first predetermined pressure or greater, into said flare stack means, said high pressure inlet means including first separating means for separating the liquid in said first combination of waste gas and liquid from the waste gas in said first combination of waste gas and liquid;

said first separating means including an inlet pipe having a first drainage aperture and a t-shaped pipe coupled to said inlet pipe, said t-shaped pipe being open at both ends of the t allowing venting of gases into the flare stack, and said drainage aperture draining said liquids into said gooseneck pipe via said routing means;

low pressure inlet means for introducing a second combination of waste gas and liquid, of a second predetermined pressure less than that of said first predetermined pressure, into said flare stack means, said low pressure inlet means including second separating means for separating the liquid in said second combination of waste gas and liquid from the waste gas in said second combination of waste gas and liquid; and means for routing the liquid separated from said first and second combination of waste gas and liquid into said gooseneck pipe.

2. An apparatus as recited in claim 1, wherein said second separating means includes:

a first inner stack having baffles;

a first fluid catch, coupled to said inner stack and having a second drainage aperture, said first fluid catch venting gases of a pressure lower than that of said high pressure gas and draining fluids contained in the gas through said second drainage aperture to said gooseneck pipe means via said routing means.

3. An apparatus for flaring gas, comprising:

a flare stack, having a base;

a fluid pit;

a gooseneck pipe coupled to the base of said flare stack and to said fluid pit, said gooseneck pipe being configured to maintain a reservoir of fluid therein at a predetermined level;

a high pressure inlet, having first means for separating, and introducing a first combination of waste gas and liquid of a first predetermined pressure or greater into said flare stack and separating the waste gas of said first combination of waste gas and liquid from the liquid of said first combination of waste gas and liquid, said high pressure inlet including:

an inlet pipe having a first drainage aperture; and a T-shaped pipe coupled to said inlet pipe, said T-shaped pipe being open at both ends of the T allowing venting of the gases into the flare stack, and said drainage aperture draining said liquids into said gooseneck pipe; and a low pressure inlet, having second means for separating, and introducing a second combination of waste gas and liquid of a second predetermined pressure less than that of said first predetermined pressure into said flare stack and separating the waste gas of said second combination of waste gas and liquid from the liquid of said second combination of gas and liquid, said low pressure inlet including:

a first inner stack having baffles;

a second inner stack coupled to said first inner stack;

a first fluid catch, coupled to said first inner stack and having a second drainage aperture, for venting gases of a pressure lower than that of said high pressure gas into said flare stack via said first inner stack and draining fluids contained in the gas through said second drainage aperture to said gooseneck pipe; and a second fluid catch, coupled to said second inner stack and having a third drainage aperture, said second fluid catch venting gases of a pressure lower than that of said first low pressure gas into said flare stack via said second inner stack and draining fluids contained in the gas through said third drainage aperture to said gooseneck pipe.

* * * * *